US007569000B2

(12) United States Patent
Wang

(10) Patent No.: US 7,569,000 B2
(45) Date of Patent: Aug. 4, 2009

(54) INTEGRATED FOLDING MECHANISM OF A TREADMILL

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 0 days.

(21) Appl. No.: 11/968,651

(22) Filed: Jan. 3, 2008

(65) Prior Publication Data

US 2009/0176627 A1 Jul. 9, 2009

(51) Int. Cl.
*A63B 22/02* (2006.01)

(52) U.S. Cl. ..... 482/54; 482/51

(58) Field of Classification Search ..... 482/51, 482/52, 54, 148, 908
See application file for complete search history.

(56) References Cited

U.S. PATENT DOCUMENTS 6,579,211 B2 * 6/2003 Wu ..... 482/54
2003/0139263 A1 * 7/2003 Wu et al. ..... 482/54
2005/0148443 A1 * 7/2005 Watterson et al. ..... 482/54
2006/0287162 A1 * 12/2006 Lo ..... 482/54
2007/0049464 A1 * 3/2007 Chou ..... 482/54
2008/0188358 A1 * 8/2008 Kuo ..... 482/54

* cited by examiner

*Primary Examiner*—Loan H Thanh
*Assistant Examiner*—Tam Nguyen

(57) ABSTRACT

An integrated folding mechanism of a treadmill having a slide pusher supported by a pneumatic cylinder at the bottom of a platform frame thereof. In this way, the rear support may be pushed upward to bring the platform frame in a vertical stable folding position or in a flat ground-touching position when the platform frame is moved upward and downward. Meanwhile, a connecting rod is interposed between the rear support and the handrail assembly such that the handrail assembly can synchronously move with the platform frame in an extracted or an folded position.

4 Claims, 6 Drawing Sheets

INTEGRATED FOLDING MECHANISM OF A TREADMILL

BACKGROUND OF THE INVENTION

1. Fields of the Invention

The invention relates to an integrated folding mechanism of a treadmill, and more particularly, to a folding mechanism that provides an excellent auxiliary and supporting force when the platform frame is moved upward in a folded position and downward in a flat position. Meanwhile, a handrail assembly is movable to create a synchronic folding and extending action.

2. Description of the Related Art

As well-known, the treadmill has a large volume and a great weight. It is therefore common to provide the platform frame of the treadmill with a fold-up function for facilitating the transportation and the storage. In view of the basic accessories of the treadmill, the fold-up mechanism can be divided into an electric and a manual folding configuration. The invention is intended for the manual folding configuration.

In fact, the conventional treadmills are not able to provide an excellent auxiliary supporting force for helping the operator to complete the fold-up or fold-down process when the platform frame is moved either in a storage position or in an operation position. Thus, the women often regard the fold-up or fold-down process of the treadmill as an impossible mission because any careless action would cause injuries to the body.

The worry about the above-mentioned operation of the treadmill can be attributed to the improper or insufficient design of the treadmill in addition to the bulky platform frame. This is the key point of the problems.

SUMMARY OF THE INVENTION

It is a primary object of the invention to eliminate the above-mentioned drawbacks and to provide a folding mechanism of a treadmill that employs a pneumatic cylinder and a slide pusher to provide an effective auxiliary and supporting force when the platform frame is moved in a vertical position or in a horizontal position. Meanwhile, a connecting rod is interposed between the rear support and the handrail assembly such that the handrail assembly can synchronically move with the platform frame in an a folded or an extended position.

According to the invention, a folding mechanism of a treadmill includes a slide pusher supported by a pneumatic cylinder at the bottom of a platform frame thereof, thereby pushing the rear support in an opposing direction to keep a ground-touching slide action at all times. Meanwhile, a connecting rod is interposed between the rear support and the handrail assembly such that the handrail assembly can synchronically move with the platform frame in an extracted or an extended position.

DETAILED DESCRIPTION OF THE PREFERRED EMBODIMENT

The present invention will now be described in more detail hereinafter with reference to the accompanying drawings that show various embodiments of the invention.

Figure 1:
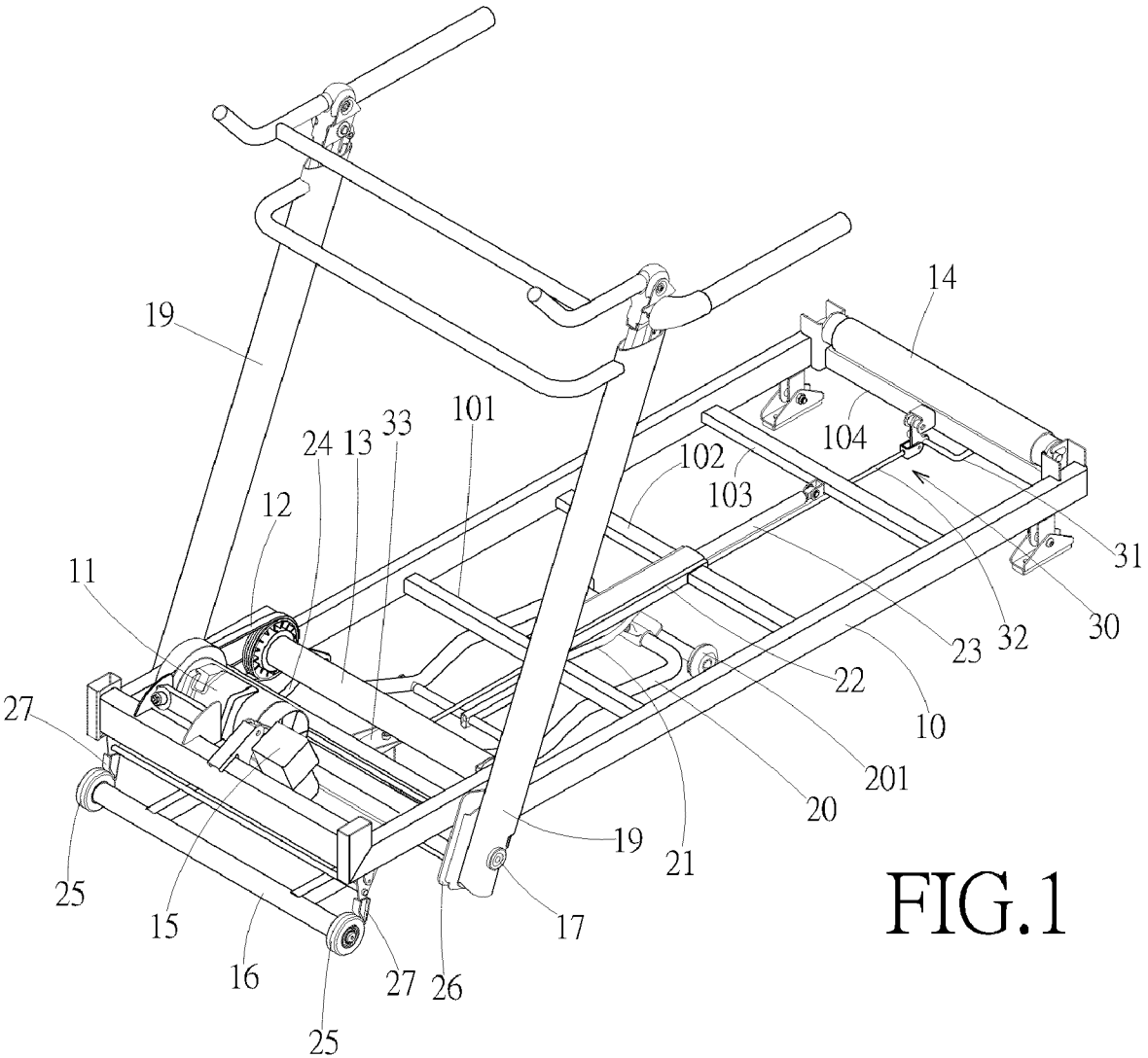
FIG. 1 is a perspective view of a preferred embodiment of the invention.
Figure 2:
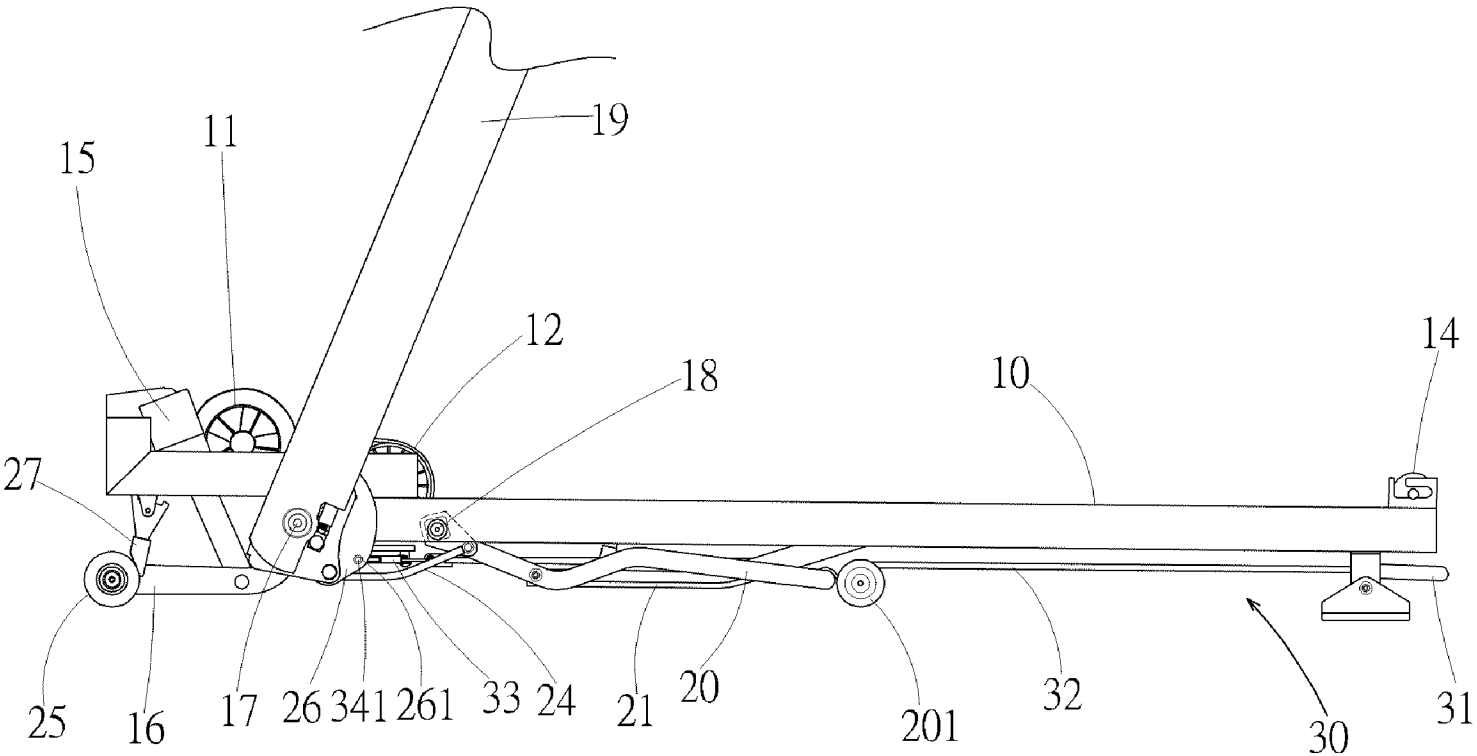
FIG. 2 is a side view according to FIG. 1.
Figure 3:
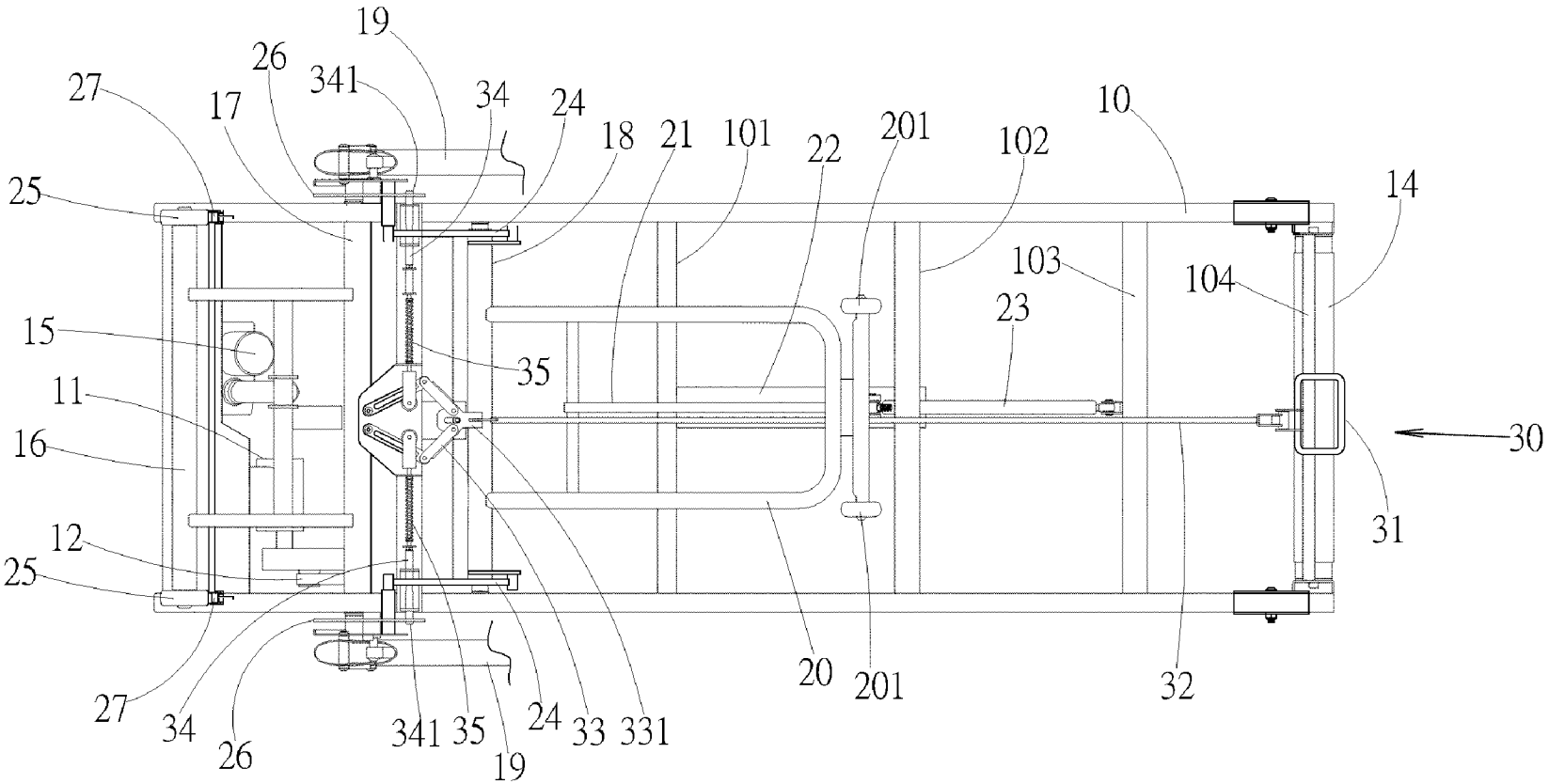
FIG. 3 is a bottom view according to FIG. 1.

Referring to FIGS. 1, 2, and 3, a platform frame 10 includes a transmission motor 11 at one side thereof for driving a continuous moving belt (not shown) into rotation by use of a transmission belt 12, a front roller 13, and a rear roller 14. Meanwhile, a lifting motor 15 is employed to move an adjusting support 16 upward and downward for adjusting the supporting angle of the platform frame 10. Moreover, two connection pins 17, 18 are disposed at both sides of the platform frame 10, respectively, for pivotally coupling a handrail assembly 19 and a rear support 20, respectively.

Moreover, a slide rail 22 providing the sliding surfaces for a slide pusher 21 is interposed between a first and a second strengthening bar 101, 102. The other end of the slide pusher 21 is pivotally connected to the rear support 20. A third strengthening bar 103 of the platform frame 10 is pivotally coupled with a pneumatic cylinder 23 at the bottom thereof in such a way that the other end of the pneumatic cylinder 23 directly rests against a tail of the slide pusher 21.

Besides, a connecting rod 24 is interconnected between the rear support 20 and the handrail assembly 19 such that the handrail assembly 19 can synchronically move with the platform frame 10 in a folded or an extended position.

An engaging mechanism 30 is disposed at the bottom of a strengthening bar 104 of the platform frame 10. The engaging mechanism 30 applies a proper engaging force to a positioning plate 26 fixed at the bottom of the internal side of the handrail assembly 19 when the platform frame 10 is brought to a horizontal application position. The engaging mechanism 30 consists of an operating lever 31, an elongated coupling rod 32, a quadruple connecting mechanism 33, two protruding studs 34 and two elastic elements 35. An external member 341 of the protruding studs 34 is engaged into a first insertion hole 261 of the positioning plate 26 in place (see FIG. 3) when the platform frame 10 is brought in a horizontal application position. The quadruple connecting mechanism 33 consists of four connecting rods which are pivotally coupled together. When the elongated coupling rod 32 is pulled by the operating lever 31, a pivot joint 331 of the quadruple connecting mechanism 33 is pulled in such a way that the quadruple connecting mechanism 33 is brought into a contracting shape distortion state. The protruding studs 34 are attached to a pulled portion at an opposing end of the quadruple connecting mechanism 33. Therefore, the protruding studs 34 are laterally shifted toward the internal side of the platform frame 10 due to the contracting deformation of the quadruple connecting mechanism 33. In this way, the external member 341 can be disengaged from the first insertion hole 261 of the positioning plate 26. Accordingly, the platform frame 10 may be lifted upwards to a folded position.

Likewise, the quadruple connecting mechanism 33 is returned back to the original position under the influence of the resilience of the elastic elements 35 when the platform frame 10 is lowered from the upright folded position to the horizontal application position. In this way, the external members 341 of the protruding studs 34 are engaged into the first insertion holes 261 of the positioning plates 26 again.

Figure 4:
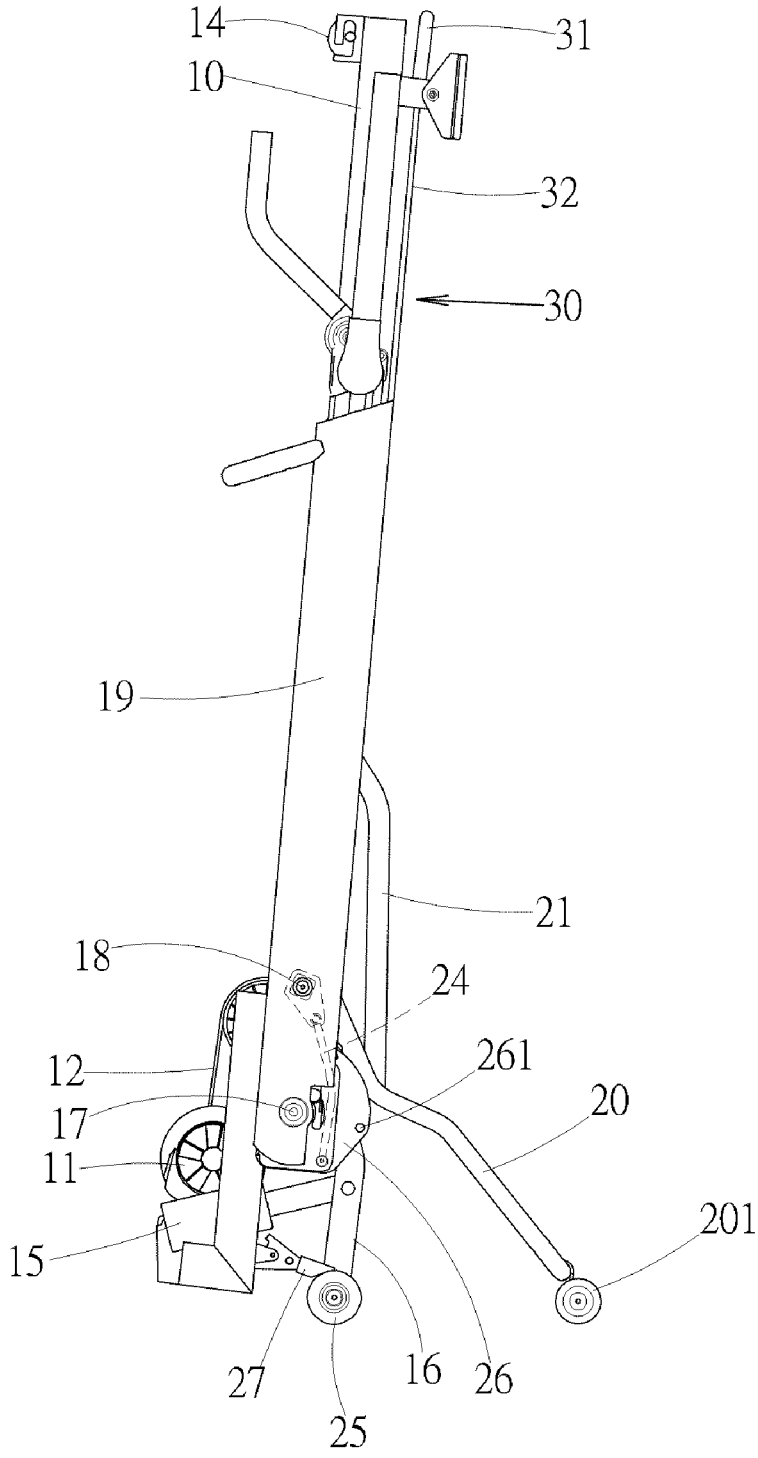
FIG. 4 is a schematic drawing according to FIG. 1 in a folded position.

As shown in FIGS. 3 and 4, the pneumatic cylinder 23 is brought into a compressed state by the weight of the platform frame 10 when the platform frame 10 is moved to a horizontal operation position. The pneumatic cylinder 23 provides an auxiliary supporting force to push the slide pusher 21 toward the front end of the platform frame 10 when the operator lifts the rear end of the platform frame 10. In this way, the rear support 20 may be also pushed toward the front end of the platform frame 10 for a ground-touching rotation until the platform frame 10 is moved in a vertical storage position. Accordingly, the platform frame 10 employs the ground-touching rollers 25 at both ends of the adjusting support 16 and the guide wheels 201 at the tail of the rear support 20 to be in contact with the ground for achieving a stable support.

Likewise, the guide wheels 201 of the rear support 20 are also brought into a ground-touching rotation under the influence of the shock mitigation provided by the pneumatic cylinder 23 when the platform frame 10 is compressed downward until the platform frame 10 is moved in a horizontal position. Accordingly, a stable and effort-saving effect is achieved.

Figure 5:
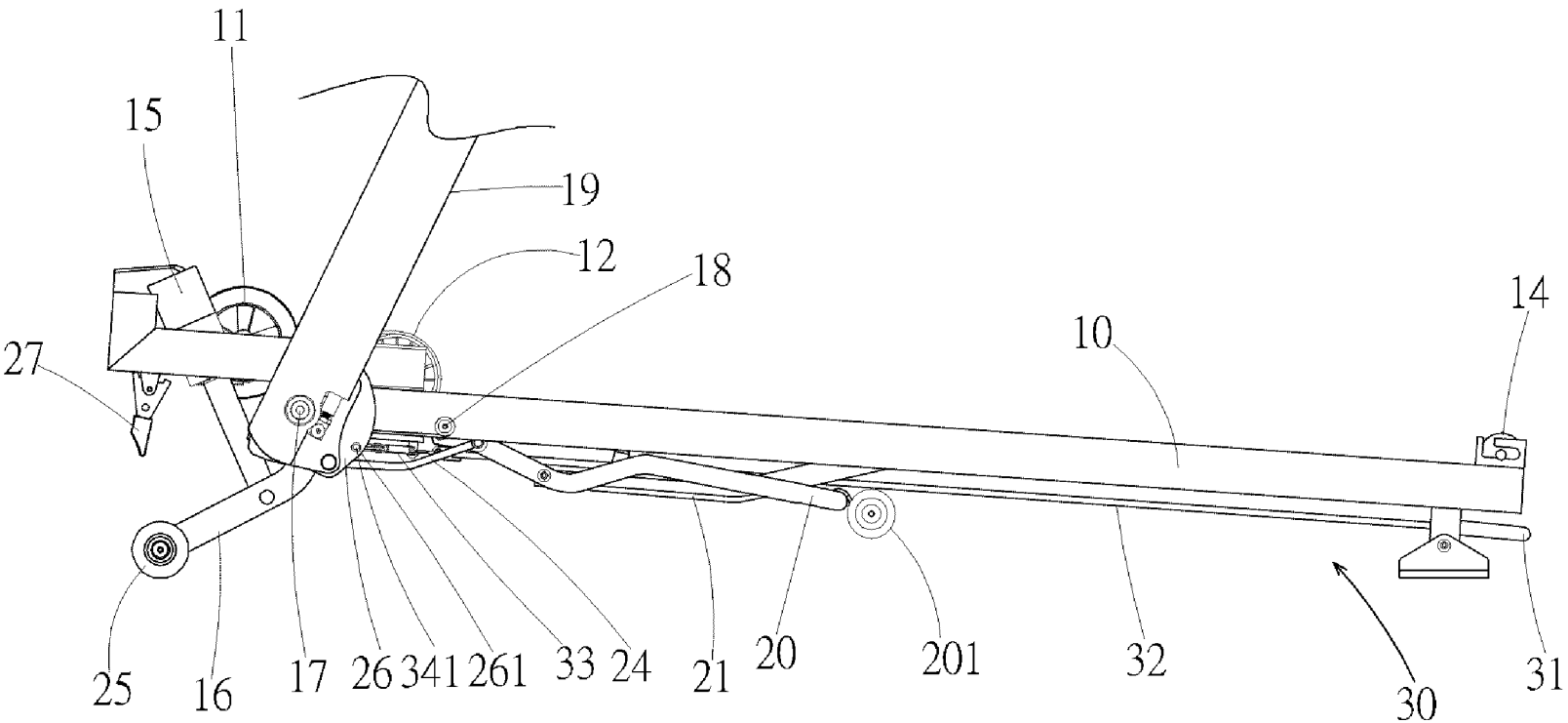
FIG. 5 is a schematic drawing in adjusting the angle of the platform frame of the invention.

As shown in FIGS. 2 and 5, both sides of the bottom of the front end of the platform frame 10 are provided with an end stop 27 extending downwards. The end stops 27 rest against ground-touching rollers 25 at both ends of the adjusting support 16 when the platform frame 10 is moved in a horizontal position (with the smallest angle). The ground-touching rollers 25 are hindered from movement when the operator undergoes the folding action of the treadmill. In this way, the entire mechanism can be prevented from sliding for a smooth folding action. As shown in FIG. 5, the end stop 27 is unimpeded by the ground-touching rollers 25 when the operator undergoes the slope adjustment of the platform frame 10 in a slanting and rising position. As a result, the action of the slope adjustment won't be affected.

Figure 6:
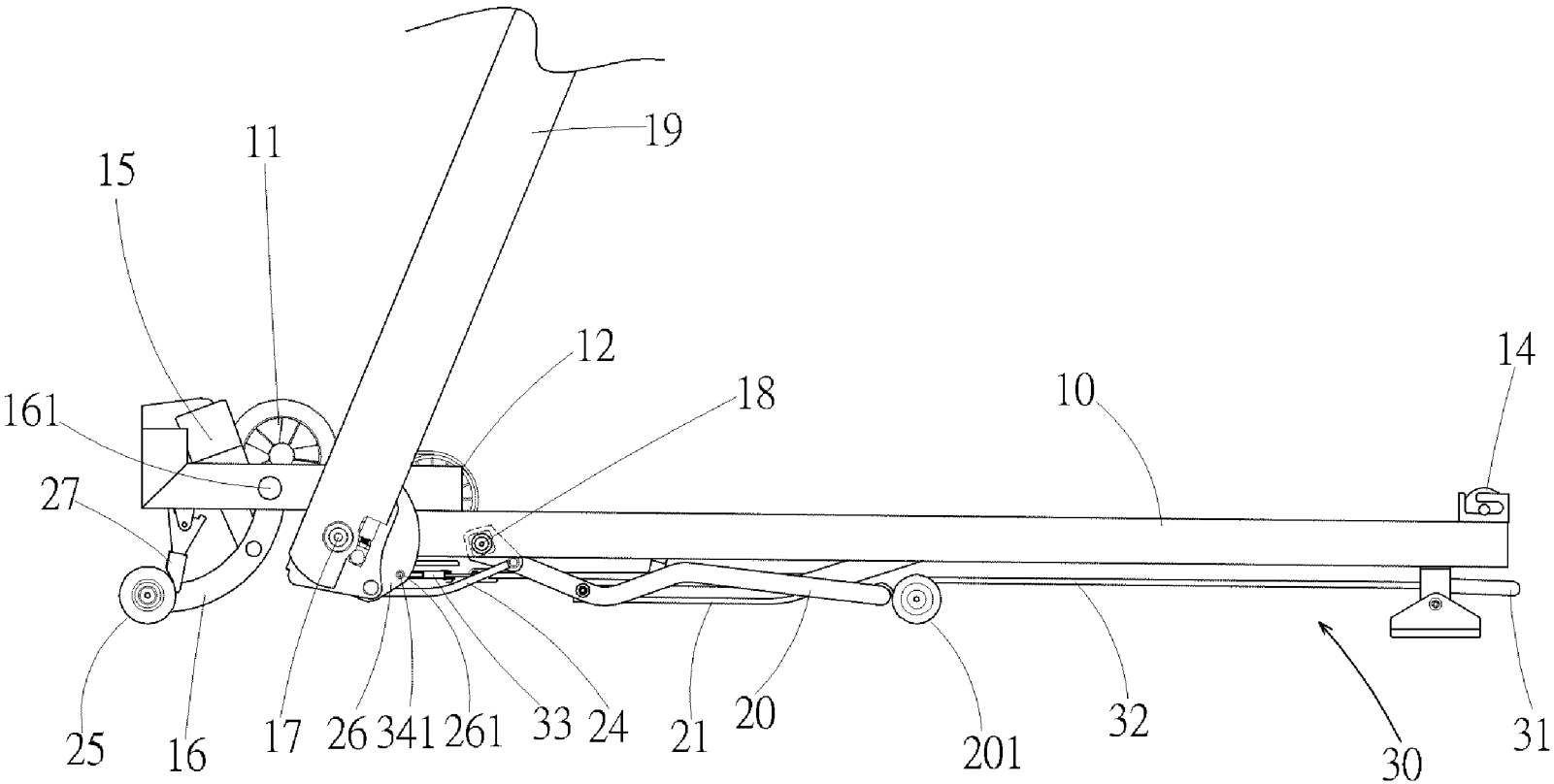
FIG. 6 is a schematic drawing of another embodiment of the invention.

Furthermore, as shown in FIG. 6, the adjusting support 16 and the platform frame 10 have an independent pivotal point 161. In other word, they do not have the same connection pin with the handrail assembly 19. In this way, a prearranged effect is also achieved.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A treadmill having an integrated folding mechanism, the treadmill comprising:

a platform frame adapted to rest on a horizontal support surface;

a transmission motor disposed at one side of the platform frame for driving a continuous moving belt into rotation by use of a transmission belt;

a front roller;

a rear roller;

a lifting motor being employed to move an adjusting support upward and downward for adjusting the incline angle of the platform frame relative to said support surface;

two connection pins being disposed on the platform frame to extend laterally from one side of the platform frame to the other side of the platform frame respectively, for pivotally coupling a handrail assembly and a rear support assembly, respectively to the platform frame;

first and second strengthening bars disposed on the platform frame to extend laterally from one side of the platform frame to the other side of the platform frame;

a slide pusher interposed between the connecting pins and the second strengthening bar and disposed on the platform frame;

a slide rail, supported by the first and second strengthening bars, provides sliding surfaces for said slide pusher, wherein one end of the slide pusher is pivotally connected to said rear support assembly;

a third strengthening bar, disposed on the platform frame, is pivotally coupled with a pneumatic cylinder at the bottom thereof in such a way that the other end of the pneumatic cylinder directly rests against a tail of the slide pusher;

a connecting rod interconnected between the rear support assembly and the handrail assembly such that the handrail assembly can synchronously move with the platform frame between a folded and an extended position; and an engaging mechanism disposed at the bottom of a fourth strengthening bar, that is connected to the platform frame, wherein the engaging mechanism can be actuated to apply a proper engaging force to a positioning plate fixed at the bottom of the internal side of the handrail assembly when the platform frame is brought into a horizontal application position.

2. The treadmill as claimed in claim 1, wherein the engaging mechanism consists of an operating lever, an elongated coupling rod, a quadruple connecting mechanism, two protruding studs and two elastic elements;

wherein an external member of the protruding studs is engaged into an insertion hole of the positioning plate when the platform frame is brought into the horizontal application position;

wherein the quadruple connecting mechanism consists of four connecting rods which are pivotally coupled together, and when the elongated coupling rod is pulled by the operating lever, a pivot joint of the quadruple connecting mechanism is pulled in such a way that the quadruple connecting mechanism is brought into a contracting shape distortion state;

wherein the protruding studs are pivotally attached to a pulled portion at an opposing end of the quadruple connecting mechanism;

whereby the protruding studs are laterally shifted toward the internal side of the platform frame due to the contracting deformation of the quadruple connecting mechanism such that the external member of the protruding studs can be disengaged from the insertion hole of the positioning plate and the platform frame may be lifted upwards into a folded position.

3. The treadmill as claimed in claim 1, wherein both sides of the bottom of the front end of the platform frame are provided with an end stop extending downwards, and the end stops rest against ground-touching rollers disposed at both ends of the adjusting support when the platform frame is moved into a horizontal position.

4. The treadmill as claimed in claim 1, wherein the adjusting support and the platform frame have a pivotal point independent of the pivotal point of the handrail connection to the platform frame.

* * * * *